US006006053A

United States Patent [19]

Ikehara

[11] Patent Number: 6,006,053

[45] Date of Patent: Dec. 21, 1999

[54] PHOTOSENSITIVE DRUM UNIT AND A GROUND PLANT USED THEREWITH

[75] Inventor: Masao Ikehara, Osaka, Japan

[73] Assignee: Mita Industrial Co., Ltd., Osaka, Japan

[21] Appl. No.: 09/038,942

[22] Filed: Mar. 12, 1998

Related U.S. Application Data

[63] Continuation of application No. 08/736,877, Oct. 25, 1996, Pat. No. 5,729,792.

[30] Foreign Application Priority Data

Nov. 21, 1995 [JP] Japan ..... 7-302941

[51] Int. Cl.[6] ..... G03G 21/00

[52] U.S. Cl. ..... 399/90; 174/51; 399/116

[58] Field of Search ..... 399/90, 116, 117, 399/159; 174/51

[56] References Cited

U.S. PATENT DOCUMENTS 5,436,699 7/1995 Komaki ..... 399/159

5,543,898 8/1996 Shishido et al. ..... 399/111

FOREIGN PATENT DOCUMENTS 7-225531 8/1995 Japan .

OTHER PUBLICATIONS

Mita Drawings 1 and 2 of Ground Plate sold in US beginning Jul. 1994.

*Primary Examiner*—Joan Pendegrass
*Attorney, Agent, or Firm*—Shinjyu An Intellectual Property Firm

[57] ABSTRACT

A photosensitive drum unit for an image forming device includes a tubular member having two openings at the opposite ends thereof, two flange members pressed into the openings of the tubular member, and an electroconductive ground plate attached to one or both of the flange members. The ground plate is provided with a plurality of projections formed integrally with the ground plate. The projections engage with the tubular member in order to create an electrical connection between the photosensitive drum and the body of the image forming device.

21 Claims, 6 Drawing Sheets

▫ = Ground plates rated as acceptable in table 2

PHOTOSENSITIVE DRUM UNIT AND A GROUND PLANT USED THEREWITH

This application is a continuation of Ser. No.: 08/736,877, filed Oct. 25, 1996, now U.S. Pat. No. 5,729,792, which is commonly assigned. The entire specification of Ser. No.: 08/736,877 is incorporated herein by reference in its entirety.

BACKGROUND OF THE INVENTION

A. Field of the Invention

The present invention relates to a drum unit and a ground plate for image forming devices such as copying machines, facsimile devices or laser printers.

B. Description of Related Art

In an image forming device such as a copying machine, an image from an original document is optically read by an exposure unit, and a electrostatic latent image is formed on a photosensitive drum. A developing device is disposed adjacent to the photosensitive drum for forming a toner image thereon. The developing device includes a toner hopper, and toner supplied from the hopper is given an electric charge opposite that of the electrostatic latent image formed on the photosensitive drum. The toner adheres to the surface of the photosensitive drum to form a toner-developed image.

The photosensitive drum includes a tubular member formed from an electroconductive metal, and two flange members which are pressed into the openings defined on the opposite ends of the tubular member. An aperture is defined in the central portion of each of the flange members, and a support axle passages through the two apertures for supporting the drum-unit in the copying machine.

In order for electricity to flow between the surface of the tubular member and the body of the copying machine, a ground plate is attached to the flange member, with a portion of the outer circumference thereof in contact with a portion of the inner circumferential surface of the tubular member and the inner circumference thereof in contact with the support axle. However, because the inner surface of the tubular member is often coated with a substance for corrosion prevention, (such as aluminum oxide), this coating must be removed so that electricity can be conducted between the tubular member and the ground plate.

In order to do this portions of the ground plate have a diameter which are larger than the inner diameter of the tubular member. The ground plate is then forced into the tubular member, thereby deforming portions of the outer circumference of the, ground plate so that it may fit into the tubular member. This action scratches the inner circumferential surface of the tubular member, and removes enough of the coating so that electricity may be conducted between the tubular member and the ground plate.

However, due to the configuration of the ground plate, the tubular member can be deformed when the ground plate is forced into the tubular member. If the tubular member is deformed in such a manner, it may produce unsatisfactory copies. In addition, the tubular member is often made thinner in order to reduce the total weight of the copying machine, as well as its cost of production. However, the amount of deformation that occurs during ground plate installation often increases when the thickness of the tubular member is reduced.

SUMMARY OF THE INVENTION

It is therefore an object of the present invention to provide a photosensitive drum unit in an image producing device in which electricity can be reliably conducted between the photosensitive drum unit and the body of the image producing device without deforming the tubular member during ground plate installation.

According to one aspect of the present invention, a photosensitive drum unit for an image reproducing device includes a tubular member having two openings at opposite ends thereof, with the,tubular member having a diameter D. At least one flange member, is connectable with the openings of the tubular member, and at least one ground plate is connectable to the flange members, the ground plate comprising a disc-shaped substrate and at least one projection which extends beyond an outer circumference of the disc-shaped substrate, and the ground plate having a diameter d. If X is defined as a thickness of said ground plate, and Y is defined as said diameter d minus said diameter D, X and Y will satisfy the inequalities $0.2\ \text{mm} \leqq X \leqq 0.4\ \text{mm}$ and $0.1\ \text{mm} \leqq Y \leqq -2.5X+1.2\ \text{mm}$.

According to yet another embodiment of the present invention, a photosensitive drum unit for an image reproducing device includes a tubular member having two openings at opposite ends thereof, the tubular member having a diameter D, At least one flange member is connectable with the openings of the tubular member, and at least one ground plate is connectable with the flange member. The ground plate has a diameter d, and includes a disc-shaped substrate having a diameter d smaller than said diameter D of said tubular member. At least one projection extends beyond an outer circumference of the disc-shaped substrate, and two cutaways are formed in the disc-shaped substrate on either side of the projection. The diameter dot the ground plate is larger than the diameter D of the tubular member.

According to yet another embodiment of the present invention, an outer circumferential surface of the flange member includes a beveled portion, which is adjacent to the projection when the ground plate and the flange member are connected to each other.

According to another embodiment of the present invention, the ground plate includes a plurality of the projections.

According to yet another embodiment of the present invention, the ground plate is composed of stainless steel.

These and other objects, features, aspects and advantages of the present invention will become more fully apparent from the following detailed description of the present invention when taken in conjunction with the accompanying drawings, where like reference numerals denote corresponding parts throughout.

DETAILED DESCRIPTION OF THE PREFERRED EMBODIMENTS

Figure 1:
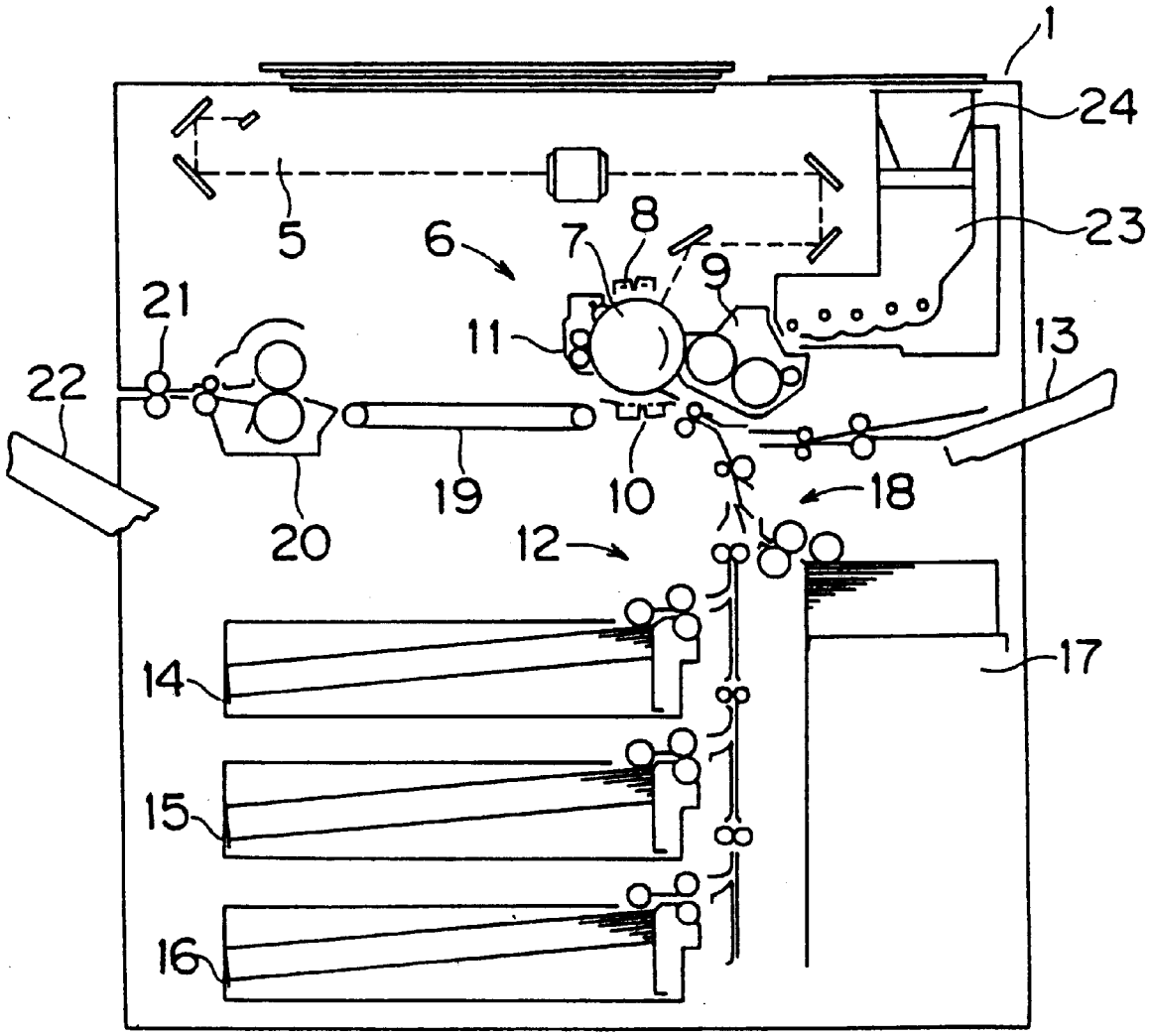
FIG. 1 is a side schematic,view of a copying machine, which includes a photosensitive drum in accordance with one embodiment of the present invention.

A cross-sectional view of the copying machine incorporating the present invention in accordance with one embodiment thereof is depicted in FIG. 1. It should be noted, however, that this invention can be applied equally as well to laser printers and facsimile devices.

The copying machine 1 includes an optical exposure system 5 for obtaining an image from an original document. The optical exposure system 5 includes a light source, mirrors and a lens unit. Located in the central portion of the copying machine 1 is an image processor 6 for forming a toner image of the original document on a blank sheet of paper. The image processor 6 includes a photosensitive drum 7, on the outer circumference of which an electrostatic latent image is formed. Surrounding the photosensitive drum 7, there is a charging device 8 for charging the photosensitive drum 7 with a predetermined level of electric charge, a developing device 9 for developing the electrostatic latent image, a transfer-separation device 10 for transferring a toner image to a sheet of paper and detaching the sheet from the photosensitive drum 7, and a cleaning device 11 for removing excess toner from the photosensitive drum 7.

A paper supply unit 12 is located in the lower portion of the copying machine 1. The paper supply unit 12 includes a bypass table 13, three paper supply cassettes 14, 15 and 16 arranged perpendicular to the lower portion of the copying machine 1, an oversized paper supply cassette 17, and a paper transporting device 18 for transporting the sheets stored in the bypass table 13 or paper supply cassettes 14–17 to the image processor 6. Disposed in a portion of the sheet-transport stream forward of the image-processor 6 are a paper discharge belt 19 for transferring the sheet toward the left side of the copying machine I in FIG. 1, a fixing device 20 for fusing and fixing toner images onto the sheet, a discharging roller 21 for discharging the sheet, and a sheet tray 22 for receiving the sheet.

A toner hopper 23 for supplying toner to the image processor 6 is attached to the developing device 9. A toner cartridge 24 is detachably connected to the toner hopper 23.

Figure 2:
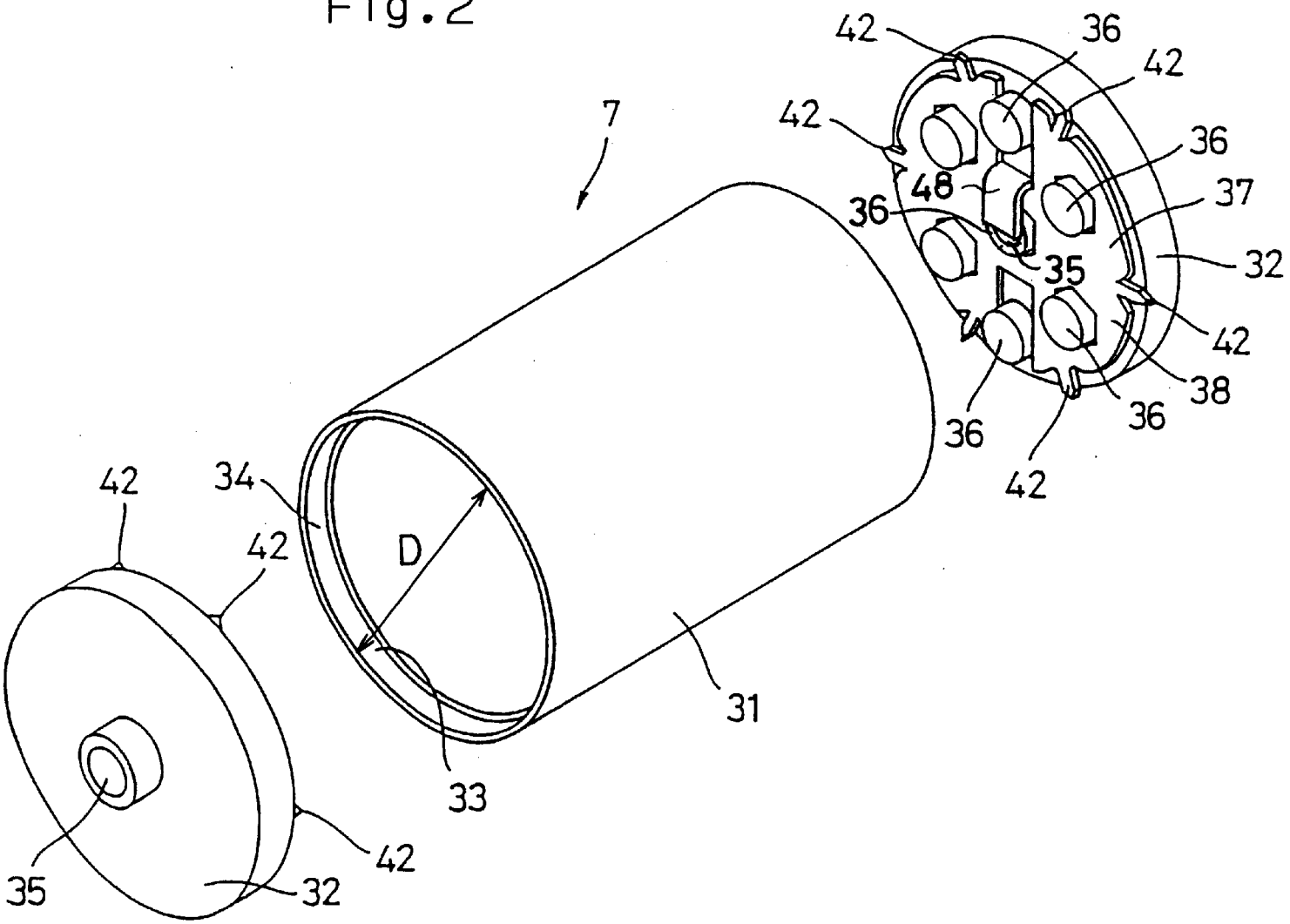
FIG. 2 is an exploded oblique view of a photosensitive drum unit, showing one embodiment of the present invention.

As shown in FIG. 2, the photosensitive drum unit 7 includes a tubular-member 31 and two flange members 32. The tubular member 31 is composed of an electroconductive metal substrate (such as aluminum or stainless steel), and an organic or non-organic photoconductor layer formed on the outer circumferential surface thereof.

The tubular member 31 includes two end portions 33, with each end portion 33 including a flange fitting portion 34.

Figure 3:
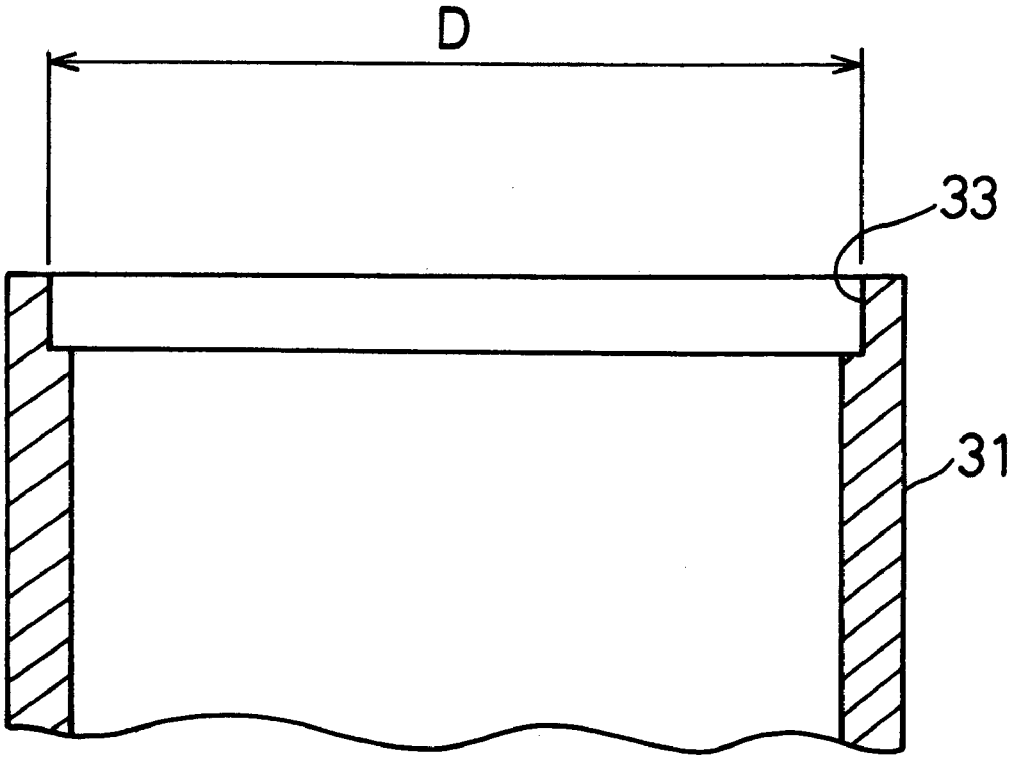
FIG. 3 is a fragmentary cross-sectional view of the tubular member depicted in FIG. 2.
Figure 4:
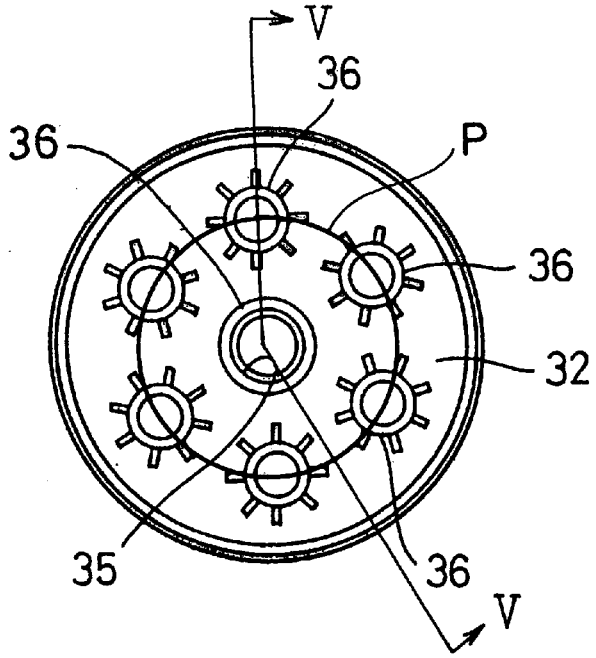
FIG. 4 is a frontal view of the flange member depicted in FIG. 2.
Figure 5:
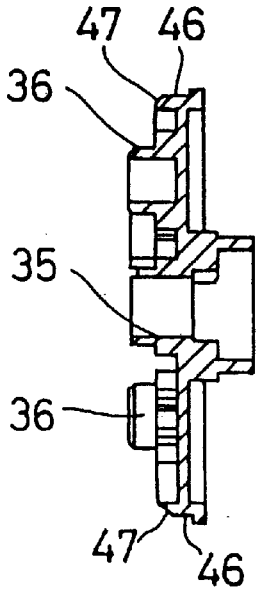
FIG. 5 is a side cross-sectional view of the flange member depicted in FIG. 4.

Each flange member 32 is composed of ABS resin and is generally disc-shaped, and is sized so that the diameter thereof is generally the same as the inner diameter D of the tubular member 31 (as shown in FIG. 3). As shown in FIGS. 2, 4, and 5, the inner side of each flange member 32 include seven first projections 36, with the first projection 36 located in the center portion of each flange member 32 provided with an aperture 35 which engages with a support axle (not shown). The outer circumferential surface of each flange member 32 constitutes a contact portion 46 which is inserted into the opening 33 of the tubular member 31. A beveled portion 47 is formed on the inner side of each flange member 32.

As stated above, one of the seven first projections 36 is located at the center of the flange member 32. The center of each of the remaining six of the seven first projections 36 define a pitch circle P shown in FIG. 4. In other words, the pitch circle P shown in FIG. 4 passes through the center of each of the six first projections 36 disposed about the centered first projection 36.

Figure 6:
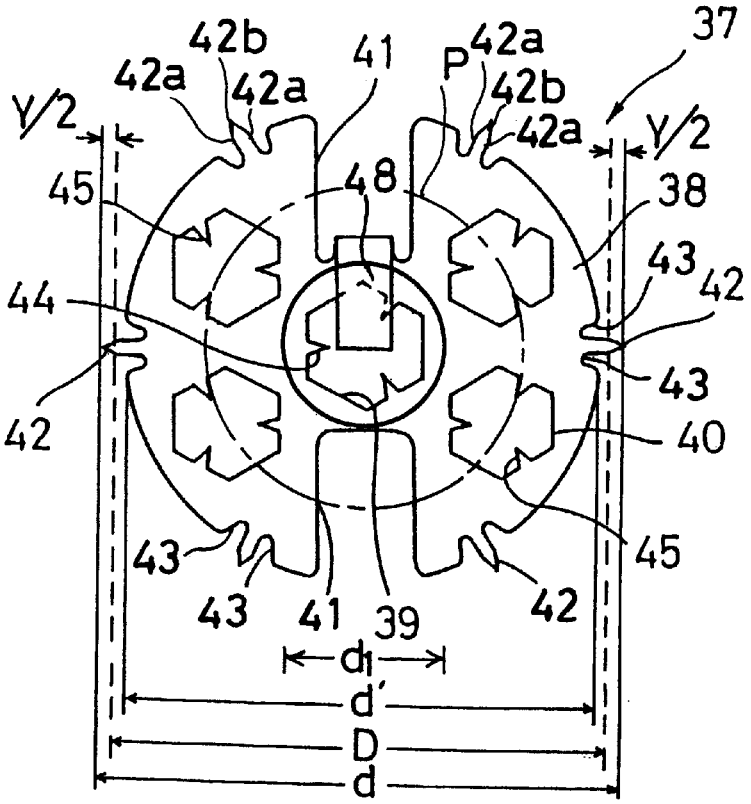
FIG. 6 is a frontal-view of the ground plate depicted in FIG. 2.

Referring now to FIG. 6, a ground plate 37 is formed of stainless steel or copper, and is attached to the inner surface of one or both flange members 32. The ground plate 37 includes a disc-shaped-substrate 38, which has a diameter d' smaller than the inner diameter D of the tubular member 31. The ground plate 37 further includes five attachment holes 40 and two cutaways 41, which correspond-to the first projections 36 on each flange member, 32. Each attachment 40 hole is provided with three second projections 45, which point inward toward the center thereof.

The ground plate 37 is also provided with six third projections 42, which extend beyond the outer periphery of the disc-shaped substrate 38. )The diameter d of each ground plate 37 is measured from the tips of opposing third projections 42, and is greater than the inner diameter D of the tubular,member 31. Two cutaways 43 are formed on either side of each of the third projections 42. The third projections 42 extend outward from the ground plate 37 between adjacent projections 42. Each third projection 42 includes two sides 42*a* and a tip portion 42*b*. The sides 42*a* extend radially outward from a center of the ground plate 37. Further, the sides 42*a* may be generally parallel to one another. The presence of these cutaways 43 and the sides 42*a* increase the elastic deformability of the third projections 42 relative to the disc-shaped substrate 38, as well as reducing the amount of pressure needed in push the flange member 32 into the tubular member 31.

The ground plate 37 is attached to the inner surface of the flange member 32 by fitting the first projections 36 into the attachment holes 40. When this occurs, the second projections 45 engage with the first projections 36, thereby securely fixing the ground plate 37 to the inner surface of-the flange member 32.

One of the cutaways 41 on the ground plate 37 includes a turn-back portion 48. After the ground plate 37 is attached to the flange member 32, the turn-back portion is bent backward and over a portion of the central attachment hole 40. Two of the first projections 36 extend into the cutaways 41. As shown in FIG. 6, the pitch circle P is larger that a diameter $d_1$ where the diameter $d_1$ is defined by an inner depth of the cutaways 41.

Figure 8:
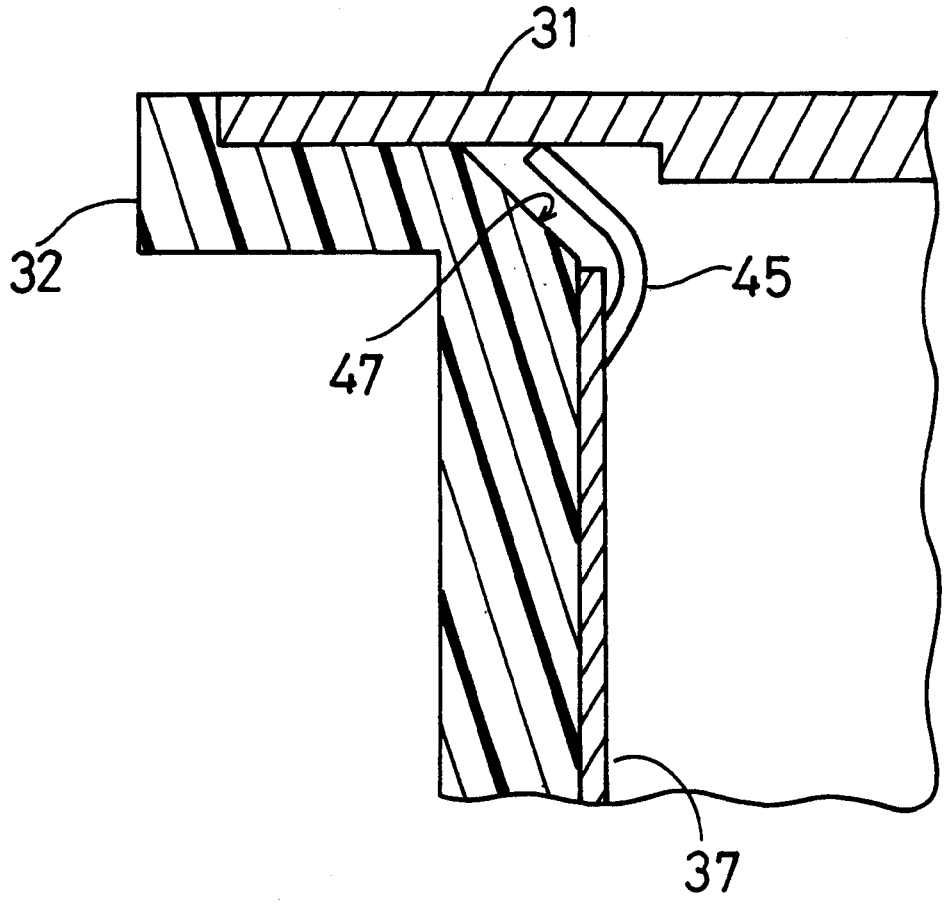
FIG. 8 is a fragmentary cross-sectional view of the flange member, the tubular member and the ground plate, showing their relative configurations when properly installed.

The flange member 32 and ground plate 37 are then forced into the opening 33 of the tubular member 31. As can be seen in FIG. 8, the third projections 42 are elastically deformed, and scratch the inner surface of the tubular member 31. As a result, the protective layer formed on the inner surface of the tubular member 31 is removed, thereby creating an electrical connection between the ground plate 37 and the tubular member 31, as well as helping secure the flange member 32 in the opening 33. In addition, the beveled portion 47 on the flange member 32 serves to provide space for the deformed third protections 45.

After connecting the flange members 32 to the opposing ends of the tubular member 31, each of the apertures 35 are engaged with the support axles (not shown) provided in the copying machine. When the support axles are inserted into the apertures 35, one end of each of the support axles are in contact with the turn-back portion 48 provided on each of the ground plates 37, thereby creating an electrical connection between the ground plates 37 and the support axles.

Table 1 shows the results of a series of experiments, in which the thickness and the diameter d of the ground plate 37 was varied in order to find a ground plate that would create an optimal electrical connection with the tubular member 31, without de-forming the tubular member 31 during installation. The overall evaluation given to each embodiment was based on the amount of deformation in the tubular member 31, the quality and quantity of electrical conduction between the tubular member 31 and the ground plate 37, the number of third projections bent after installation of the ground plate 37 into the tubular member 31, and the number of scratches in the inner surface of the tubular member 31. The thickness of the tubular ember 31 in this experiment was 0.8 mm.

TABLE 1

| Thickness of ground plate | d-D | Amount of deformation in tubular member | Electrical conduction | Number of bent projections | Number of scratches | Overall evaluation |
|---|---|---|---|---|---|---|
| 0.1 mm | 0.1 mm | none | none | — | — | failure |
| 0.1 mm | 0.2 mm | none | some | — | — | failure |
| 0.1 mm | 0.3 mm | none | some | — | — | failure |
| 0.2 mm | 0.1 mm | none | great | 2–3 | 2–3 | failure |
| 0.2 mm | 0.2 mm | none | great | 3–4 | 3–4 | acceptable |
| 0.2 mm | 0.3 mm | none | great | 5–6 | 5–6 | best |
| 0.3 mm | 0.1 mm | none | great | 1 | 1 | failure |
| 0.3 mm | 0.2 mm | none | great | 3–4 | 3–4 | acceptable |
| 0.3 mm | 0.3 mm | none | great | 5–6 | 5–6 | good |
| 0.4 mm | 0.1 mm | none | great | 0 | 1–2 | failure |
| 0.4 mm | 0.2 mm | none | great | 2–3 | 2–3 | failure |
| 0.4 mm | 0.3 mm | some | great | 5–6 | 5–6 | failure |
| 0.4 mm | 0.5 mm | great | great | 6 | 6 | failure |
| 0.5 mm | 0.1 mm | great | great | — | — | failure |
| 0.5 mm | 0.2 mm | great | great | — | — | failure |
| 0.5 mm | 0.3 mm | great | great | — | — | failure |

Table 2 shows the results of a series of experiments similar to those in Table 1, except that the overall evaluation given to each embodiment was based only on the amount of deformation to the tubular member 31 and the quantity and quality of the electrical conduction between the tubular member 31 and the ground plate 37.

TABLE 2

| Thickness of ground plate | d-D | Amount of deformation in tubular member | Electrical conduction | Overall Evaluation |
|---|---|---|---|---|
| 0.1 mm | 0.1 mm | none | none | failure |
| 0.1 mm | 0.2 mm | none | some | failure |
| 0.1 mm | 0.3 mm | none | some | failure |
| 0.1 mm | 0.4 mm | none | some | failure |
| 0.1 mm | 0.5 mm | none | some | failure |
| 0.1 mm | 0.6 mm | none | some | failure |
| 0.1 mm | 0.7 mm | none | some | failure |
| 0.1 mm | 0.8 mm | none | some | failure |
| 0.2 mm | 0.1 mm | none | great | acceptable |
| 0.2 mm | 0.2 mm | none | great | acceptable |
| 0.2 mm | 0.3 mm | none | great | acceptable |
| 0.2 mm | 0.4 mm | none | great | acceptable |
| 0.2 mm | 0.5 mm | none | great | acceptable |
| 0.2 mm | 0.6 mm | none | great | acceptable |
| 0.2 mm | 0.7 mm | none | great | acceptable |
| 0.2 mm | 0.8 mm | none | some | failure |
| 0.3 mm | 0.1 mm | none | great | acceptable |
| 0.3 mm | 0.2 mm | none | great | acceptable |
| 0.3 mm | 0.3 mm | none | great | acceptable |
| 0.3 mm | 0.4 mm | none | great | acceptable |
| 0.3 mm | 0.5 mm | none | some | failure |
| 0.3 mm | 0.6 mm | none | none | failure |
| 0.3 mm | 0.7 mm | none | none | failure |
| 0.3 mm | 0.8 mm | none | none | failure |
| 0.4 mm | 0.1 mm | none | great | acceptable |
| 0.4 mm | 0.2 mm | none | great | acceptable |
| 0.4 mm | 0.3 mm | some | great | failure |
| 0.4 mm | 0.4 mm | great | great | failure |
| 0.4 mm | 0.5 mm | great | great | failure |
| 0.5 mm | 0.1 mm | great | great | failure |
| 0.5 mm | 0.2 mm | great | great | failure |
| 0.5 mm | 0.3 mm | great | great | failure |

Figure 7:
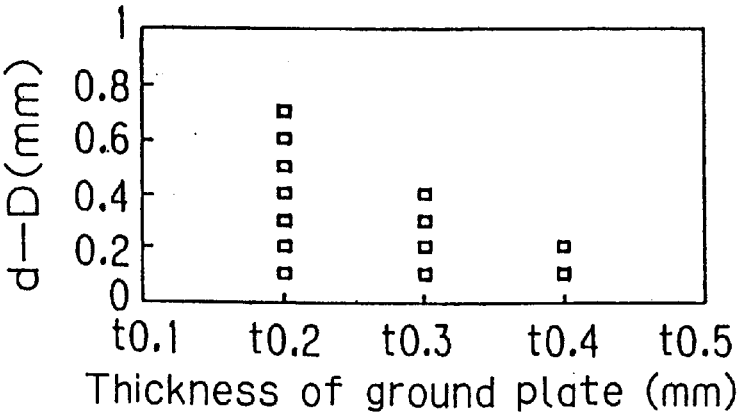
FIG. 7 is a chart showing the relationship between the thickness of the ground plate and the difference in diameters of the tubular member and the ground plate.

FIG. 7 shows a graphical representation of the embodiments in Table 2 which received an "acceptable" rating. As can be seen therein, "acceptable" embodiments will satisfy the inequalities $0.2\ \text{mm} \leqq X \leqq 0.4\ \text{mm}$ and $0.1\ \text{mm} \leqq Y \leqq -2.5X+1.2\ \text{mm}$, wherein X=the thickness of the ground plate and Y=the difference between inner diameter D of the tubular member 31 and the diameter d of the ground plate 37.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A photosensitive drum unit for an image reproducing device, comprising:

a tubular member having at least one opening one end thereof, said tubular member having an inner diameter D, at least one flange member connectable with said openings of said tubular member, a ground plate coupled to said flange member, said ground plate having a disc-shaped substrate having a diameter d' smaller than said inner diameter D of said tubular member, at least one projection which extends beyond an outer circumference of said disc-shaped substrate, said projection defining a diameter d of said ground plate, said projection formed with radially extending sides, said disk-shaped substrate being formed with two cutaways formed on opposite radial sides of said disk-shaped substrate circumferentially spaced apart from said projection;

wherein said diameter d of said ground plate is larger than said diameter D of said tubular member, and at least one of said two cutaways is formed with a turn back extension which extends toward a central portion of said ground plate, said turned back extension being configured for contact with an axially extending member which is configured to extend through a central aperture in said ground plate.

2. The photosensitive drum unit as in claim 1, wherein said flange is formed with at least two projections, said projections extending into said two cutaways.

3. The photosensitive drum unit as in claim 2, wherein said projections define a pitch circle P on said flange, said pitch circle being larger than a diameter $d_1$ defined between inner portions of said two cutaways.

4. The photosensitive drum unit as in claim 1, wherein said radially extending sides of said projection are generally parallel to one another.

5. The photosensitive drum unit as in claim 4, wherein said projection is further formed with a pointed tip at an end of said radially extending sides.

6. The photosensitive drum unit as in claim 1, wherein a plurality of said projections are formed on said ground plate, each of said projections being circumferentially spaced apart from one another.

7. The photosensitive drum unit as in claim 6, wherein pairs of second cutaways are formed in said disc-shaped substrate on opposing circumferential sides of each of said projections.

8. The photosensitive drum unit as in claim 6, wherein pairs of second cutaways are formed in said disc-shaped substrate on opposing circumferential sides of each of said projections.

9. The photosensitive drum unit as set forth in claim 1 wherein:

said tubular member is an electro-conductive drum having flange-fitting open ends configured to receive said flange member, said flange member has an inner face from which attachment bosses project, each of said bosses having a center, said centers of said bosses lying on a circle concentric with a center of said flange member, said ground plate is perforated by attachment holes for receiving said bosses, said attachment holes having centers that coincide with said circle, and said ground plate is adapted for attachment to said flange member and in response to fitting into said flange-fitting open ends of said tubular member said projection of said ground plate is elastically deformable thereby minimizing deformation of said tubular member.

10. A photosensitive drum unit as set forth in claim 9, wherein said ground plate is perforated by a central aperture for receiving a support axle, and said turned back extension is configured to contact said support axle thereby providing electrical contact between said tubular member and said support axle.

11. A photosensitive drum unit as set forth in claim 9, wherein an inner face of said flange member has a beveled rim.

12. A photosensitive drum unit as set forth in claim 9, wherein said ground plate is made of stainless steel.

13. A photosensitive drum unit for an image reproducing device, comprising:

a tubular member having at least one opening one end thereof, said tubular member having an inner diameter D, one flange member connectable with said openings of said tubular member, a ground plate coupled to said flange member, said ground plate having a disc-shaped substrate having a diameter d' smaller than said inner diameter D of said tubular member, two projections, each of said projections extending radially outward from said disc-shaped substrate beyond an outer circumference of said disc-shaped substrate, said projections defining a diameter d of said ground plate, said projections formed with radially extending sides, said disk-shaped substrate being formed with two cutaways formed on opposite radial sides of said disk-shaped substrate circumferentially spaced apart from said projections;

wherein said diameter d of said ground plate is larger than said diameter D of said tubular member, and at least one of said two cutaways is formed with a turn back extension which extends toward a central portion of said ground plate, said turned back extension being configured for contact with an axially extending member which is configured to extend through a central aperture in said ground plate.

14. The photosensitive drum unit as in claim 13, wherein said flange is formed with at least two projections, said projections extending into said two cutaways.

15. The photosensitive drum unit as in claim 14, wherein said projections define a pitch circle P on said flange, said pitch circle being larger than a diameter $d_1$ defined between inner portions of said two cutaways.

16. The photosensitive drum unit as in claim 13, wherein said radially extending sides of said projections are generally parallel to one another.

17. The photosensitive drum unit as in claim 16, wherein said projection is further formed with a pointed tip at an end of said radially extending sides.

18. The photosensitive drum unit as set forth in claim 13, wherein:

said tubular member is an electro-conductive drum having flange-fitting open ends configured to receive said flange member, said flange member has an inner face from which attachment bosses project, each of said bosses having a center, said centers of said bosses lying on a circle concentric with a center of said flange member, said ground plate is perforated by attachment holes for receiving said bosses, said attachment holes having centers that coincide with said circle, and said ground plate is adapted for attachment to said bosses, and in response to fitting into said flange-fitting open ends of said tubular member said two projections of said ground plate are elastically deformable thereby minimizing deformation of said tubular member.

19. A photosensitive drum unit as set forth in claim 18, wherein said ground plate is perforated by a central aperture for receiving a support axle, and said turned back extension is configured to contact said support axle thereby providing electrical contact between said tubular member and said support axle.

20. A photosensitive drum unit as set forth in claim 18, wherein an inner face of said flange member has a beveled rim.

21. A photosensitive drum unit as set forth in claim 18, wherein said ground plate is made of stainless steel.

* * * * *